US006987523B2

(12) United States Patent
Fujiwara

(10) Patent No.: US 6,987,523 B2
(45) Date of Patent: Jan. 17, 2006

(54) PAPER FEEDER AND PRINTER

(75) Inventor: Hitoshi Fujiwara, Nagano (JP)

(73) Assignee: F&F Limited, (JP)

( * ) Notice: Subject to any disclaimer, the term of this patent is extended or adjusted under 35 U.S.C. 154(b) by 110 days.

(21) Appl. No.: 10/473,013

(22) PCT Filed: Mar. 26, 2002

(86) PCT No.: PCT/JP02/02875

§ 371 (c)(1),
(2), (4) Date: Jan. 29, 2004

(87) PCT Pub. No.: WO02/076864

PCT Pub. Date: Oct. 3, 2002

(65) Prior Publication Data

US 2004/0119807 A1 Jun. 24, 2004

(30) Foreign Application Priority Data

Mar. 26, 2001 (JP) ..... 2001-088184

(51) Int. Cl.
*B41J 15/00* (2006.01)
*B41J 15/04* (2006.01)
*B41J 15/16* (2006.01)

(52) U.S. Cl. ..... 347/218; 400/618; 400/619

(58) Field of Classification Search ..... 347/218; 400/618, 619; 493/459; 162/197, 271; 399/406; 271/161, 188, 209
See application file for complete search history.

(56) References Cited

U.S. PATENT DOCUMENTS 5,316,539 A 5/1994 Leemhuis et al.
5,533,821 A * 7/1996 Awai et al. ..... 400/619
5,566,906 A 10/1996 Kamada et al.
6,064,853 A 5/2000 Embry et al.

FOREIGN PATENT DOCUMENTS

| | | |
|---|---|---|
| JP | 63-196447 | 8/1988 |
| JP | 04-164764 | 6/1992 |
| JP | 04-292364 | 10/1992 |
| JP | 05-000749 | 1/1993 |
| JP | 05-186116 | 7/1993 |
| JP | 06-001514 | 1/1994 |
| JP | 07-046365 | 2/1995 |
| JP | 08-081104 | 3/1996 |
| JP | 11-180613 | 7/1999 |
| JP | 11-322149 | 11/1999 |

OTHER PUBLICATIONS

International Search Report (dated Apr. 4, 2002).
Internationl Preliminary Examination Report (English Translation).

* cited by examiner

*Primary Examiner*—Huan Tran
(74) *Attorney, Agent, or Firm*—Blank Rome LLP

(57) ABSTRACT

A paper feeding apparatus of this invention comprises a feed roller and a paper holding member for nipping and feeding roll paper; and a first paper guide that has a first guide surface against which the roll paper outputted from the feed roller is pushed. The first guide surface is tilted so as to guide the roll paper in a direction opposite to a curving direction of the roll paper. In this paper feeding apparatus, the roll paper is pushed against the guide surface for removing the curl. Therefore, the curl is removed efficiently. The mechanism for removing the curl becomes simple and load of motor is reduced. The paper feeding apparatus can be applied to a compact printer that is carried with a mobile phone.

23 Claims, 8 Drawing Sheets

PAPER FEEDER AND PRINTER

TECHNICAL FIELD

The present invention relates to a printing apparatus and a paper feeding apparatus that can correct the curl of roll paper.

BACKGROUND ART

Printing apparatuses, such as printers and fax machines that print onto roll paper are conventionally known. Compared to apparatuses that print onto cut sheets, such printing apparatuses require less space for storing printing paper and so can be produced in more compact overall sizes. However, the curling tendency of roll paper causes problems when printing on roll paper. The curling tendency remains for roll paper that has been printed upon and outputted from a printing apparatus, so that such paper curls after output. This means that even if the printed paper is cut into a predetermined size, such as Japanese A4 size, when it is outputted from a printer, it is not possible to store the printed paper in a stack in a paper stocker or the like. Since the outputted paper sheets are curled, it is more difficult to gather a plurality of sheets together in a bundle and file the sheets. Accordingly, printing paper in the form of sheets or pre-cut sheets are preferred at present for printing, and printers and fax machines are made large in order to store printing paper in the form of sheets.

The increasingly widespread use of mobile terminals such as PDAs and mobile telephones has been accompanied with strong demands for compact printers that can be used together with such devices even if the user is out of office. While printers that use roll paper as the printing paper are suited to being made compact, for such printers to be easy to use, it is important to correct, remove or straighten the curling tendency (the curl) of the roll paper using a compact mechanism. In particular, since a compact printing apparatus for a mobile terminal such as a PDA will need to use roll paper with a diameter of around 10 mm or less, the printed paper ("print out") outputted will be sure to curl and ends up curling up with a diameter of 10 mm or less. Compared to print outs that have curled up with a large diameter, print outs that have curled up with a small diameter are much more difficult to handle, so that it becomes very important to correct the curling tendency.

A mechanism in which roll paper is pressed by a paper guide with a sharp-angled tip using a spring or other force can conceivably be used as a mechanism for removing the curl of roll paper. However, since setting the paper guide with the sharp-angled tip on the paper pass makes the paper route being changed, and a space for the spring for pressing the paper guide onto the paper is necessary, a large space is occupied by the mechanism for correcting the curl. Accordingly, it is not possible to realize a compact printer. Also, the curl-correcting performance is not especially high, so that there is the fundamental problem that the method of the above is essentially not effective for roll paper with a small diameter.

Also, since the roll paper is additionally held by the paper guide and the spring on the paper pass, there is increased resistance for paper feeding, which makes it necessary to use a motor with an output that can handle this load. Accordingly, the size of the motor increases and power consumption also increases, which makes this technology even less suited to the realization of a compact printer.

In addition, since the roll paper is held by the paper guide with the sharp-angled tip and the spring on the paper pass, when the printer is a standby mode, the roll paper is continuously held by the sharp-angled tip, so the held part becomes curled in the opposite direction. Accordingly, print-outs become a paper curled as a whole in the same direction as the roll paper but have tips that curl in the opposite direction, such print-outs are extremely difficult to handle and also have a poor appearance. It is possible to prevent curling in the opposite direction through methods such as moving the spring away when the printer is in standby mode, though enclosing a mechanism for doing so further increases the size of a printer and also increases the cost.

For this reason, it is an object of the present invention to provide a paper feeding apparatus that is compact and is capable of correcting the curling tendency of roll paper and also a printing apparatus equipped with such paper feeding apparatus. It is a further object to provide a paper feeding apparatus that can suppress increases in the load of a motor and does not impart a tendency in. the opposite direction, and also a printing apparatus equipped with such paper feeding apparatus. It is yet another object to provide a printing apparatus that uses roll paper as the printing paper, is easy to use, and is extremely compact so as to be well suited to being carried together with a mobile terminal such as a mobile phone.

DISCLOSURE OF THE INVENTION

For the above reason, the present invention includes a surface which is tilted in an opposite direction to the direction in which the roll paper is bent or curled and against which outputted roll paper is pushed by a coordinated operation by a paper holding plate, such as a sub roller or platen, and a feed roller, with this tilted surface being struck by the roll paper and the paper feeding force and the rigidity or resistance to being folded over of the roll paper itself (folding resistivity of the paper) being used to remove the curling tendency. The paper feeding apparatus of the present invention comprises: a feed roller and a paper holding member for nipping (holding) and feeding roll paper; and a first paper guide that has a first guide surface against which the roll paper outputted from the feed roller is pushed and the first guide surface is tilted so as to guide the roll paper in an opposite direction to a curving direction.

With this paper feeding apparatus, there is no holding and stretching of the roll paper on the paper route or pulling and stretching of the paper in the opposite direction to the paper feeding direction, so that there is almost no increase in the load when feeding the paper. The roll paper strikes the first guide surface at an exit of the feed roller, so that somewhat of a load is generated, but since the paper is fed in a largely free state along the first guide surface without the paper being held, pulled or stretched, compared to methods that remove curl by holding the paper, the increase in the load of the motor that is required to remove the curl can be halved or reduced even more.

Experiments by the inventors have confirmed that the paper feeding apparatus of the present invention is capable of removing the curling tendency of roll paper with extremely high efficiency. In the paper feeding apparatus of the present invention, roll paper with a curling tendency strikes the first guide surface at the exit of the feed roller and the roll paper is fed so as to bend in the opposite direction to the curl or curving direction. By disposing the first guide surface near the feed roller and/or providing a paper guide that guides both surfaces of the roll paper between the feed roller and the first surface and guides the roll paper to the first guide surface without sagging significantly, the rigidity or strength of the roll paper itself can be used to push the roll paper against the first guide surface with a strong force. Accordingly, the roll paper that is fed by the feed roller bends sharply in the opposite direction to the curling tendency at the point that strikes the first guide surface. Also, the roll paper itself has rigidity (resistance to being folded over), so that a sufficient force for pressing the roll paper against the first guide surface and sharply bending the roll paper is transmitted from the feed roller via the roll paper itself to the part of the roll paper that strikes the first guide surface. As a result, it is thought that, at the first guide surface, the part of roll paper bends in the opposite direction to the curling tendency with extending or stretching the part, thereby removing the curl with high efficiency.

In this paper feeding apparatus, when the printer is in a standby state, the roll paper is not being fed by the feed roller; therefore, the roll paper is not strongly pressed against the first guide surface. This means that curling of the roll paper in the opposite direction is avoided.

The paper feeding apparatus of the present invention has merits that load on the motor for feeding paper is little, the curling tendency is efficiently removed and the imparting of curve in the opposite direction is avoided. In addition, the paper feeding apparatus has an extremely simple construction of a first paper guide with a first guide surface, a feed roller, and a paper holding member, so that a compact paper feeding apparatus that can efficiently remove the curling roll paper is provided. By installing the paper feeding apparatus of the present invention in a printing apparatus, it is possible to provide a compact printing apparatus that uses roll paper. The printer of this invention is easy to use since it outputs roll paper with the curling tendency removed, and is compact and so suited to being carried with a mobile terminal, such as a mobile phone.

In the paper feeding apparatus of the present invention, it is preferable for the first paper guide to be disposed in the vicinity of the feed roller and in particular for the distance between the feed roller and the first guide surface to be 10 mm or below. When the first paper guide is disposed in the vicinity of the feed roller, the roll paper can be prevented from sagging between the first guide surface and the feed roller, and the rigidity (strength, stiffness) of the roll paper is used so that the roll paper can be reliably pushed against the first guide surface. Accordingly, it is possible to reliably remove the curl. In addition, since the feed roller is near the first paper guide in this layout, the paper feeding apparatus becomes compact.

By tilting the first guide surface by 45 degrees or above with respect to the direction in which the roll paper strikes the first guide surface, almost sufficient slant for removing the curl can be produced. However, the strength of the curling tendency of the roll paper is influenced by the diameter of the roll paper and the quality of the paper rolled. The strength of the curling tendency differs between the first part of the roll paper and the end part of the roll paper, and differs according to the diameter of the roll paper. Accordingly, it is preferable to provide a means that can adjust or change the angle (or slant) of the first guide surface and/or the distance (or gap) between the first guide surface and the feed roller, so that curling tendencies of different strengths can be flexibly corrected by changing the angle by which the roll paper is forced to bend.

It is effective to provide a second paper guide that has a second guide surface for guiding or leading the roll paper outputted from the feed roller to the vicinity of the first paper guide. Using the second guide surface, the position and angle at which the roll paper outputted from the feed roller strikes the first guide surface becomes easily adjustable according to the construction of the printer and the strength of the curling tendency. It is also possible, by the second guide surface, to maintain the conditions and/or the positional relationship between the roll paper and the first guide surface for efficiently removing the curling tendency. For example, the second guide surface can prevent moving the point where the roll paper strikes the first guide surface on that surface as the paper is fed. The moving of the point where the roll paper is bent reduces the angle by which the roll paper is forced to bend in the opposite direction and becomes the ability to remove the curling tendency unstable.

It should preferably be possible to adjust the angle of the first guide surface according to the strength of the curl of the roll paper. When the first paper guide is close to the contact point between the feed roller and the roll paper, when the first paper guide is rotated in order to adjust the angle of the first guide surface, it is easy for the first paper guide and feed roller to interfere with one another. Accordingly, the range of angle of the first guide surface would be limited and it may sometime cause difficult to efficiently remove the curling tendency. On the other hand, when the first paper guide and feed roller are placed apart, the roll paper sags between them and it may cause no longer possible to make use of the rigidity (resistance to being folded over) of paper itself. When a second paper guide is provided, it is possible to guide the roll paper in a straight line with respect to the first guide surface that is disposed at a position somewhat distant from the feed roller, so that the rigidity of paper itself can be used and the roll paper can be pushed onto the first guide surface. At the same time, the distance or gap from the feed roller to the first guide surface can be secured, so that the angle of the first guide surface can be set at the most suitable angle for removing the curl.

It is possible to integrate the paper holding member and the second paper guide. As one example, the paper holding member may be a paper guide with a part that presses the roll paper onto the feed roller for nipping and a flat guide surface that guides the roll paper as far as a vicinity of the first guide surface. When the first paper guide is comparatively far from the feed roller, it is preferable to provide a fourth paper guide that has opposing guide surfaces so that the roll paper is guided from the output side of the feed roller to the first guide surface. A part of the fourth paper guide on the output side functions as the second paper guide.

It is important for the distance or gap between the second guide surface and the first guide surface to be short enough for the folding resistivity of the paper to be used for pressing or pushing. As one example, it is preferable for the distance between the output end of the second guide surface and the first guide surface to be 5 mm or less. By making the corner of the output end of the second paper guide at a right angle or an acute angle, it is possible to stably push the roll paper onto the first guide surface at an angle at which the curl can be removed.

In order to adjust the ability to remove the curl of the roll paper, it should preferably be made possible to adjust the gap (or distance) between the second guide surface and the first guide surface and/or the angle between (or slope of) the first guide surface and the second guide surface. The strength of the curling tendency is influenced by the diameter of the roll paper and the strength of the curling tendency is different at the start and at the end of the roll paper, with such differences tending especially large for roll paper with a small diameter. For this reason, it is preferable to provide means for indicating, in relation to a remaining diameter of the roll paper, an adjustment amount for a means for adjusting so as to make it possible for the user to easily control the distance and/or angle. The means for adjusting the distance and/or angle may make adjustments automatically in coordination with the remaining diameter.

When the paper feeding apparatus of the present invention is used in a printing apparatus, the printing mechanism such as the print head may be provided separately. Also, a line thermal head can be made to function as both the print head and the paper holding member. A platen roller is set as the feed roller, and the roll paper is nipped and fed by the platen roller and the line thermal head. In this printing apparatus, the paper feeding apparatus for removing the curl of roll paper and the printing mechanism is integrated. Accordingly, it is possible to provide a compact, low-cost printing apparatus that can efficiently de-curl with a small number of components. A line thermal printing apparatus does not need consumables such as ink, and so is even more suited to a compact printing apparatus.

In a printing apparatus where the first paper guide is a flat platen and a print head prints onto roll paper that is supported on the first guide surface, the printing mechanism and the paper feeding apparatus can be integrated or can use common parts, so that a compact, low-cost printing apparatus can be provided. The print head can be a line-type head or a serial printer, the serial printer head moving along the first guide surface. One example of a serial-type print head is an ink jet type.

When printing onto roll paper, it is customary to print on the outer surface of the roll paper. However, if the roll paper, the feed roller, and the print head are arranged in a line in that order to make maintenance and the setting of the roll paper easy, the printed surface faces downwards. An arrangement where a printing apparatus is attached to the top of a mobile terminal is preferable. In such cases, from the printer integrated with the mobile terminal, the printed roll paper is discharged towards the terminal and the paper will hide the screen of the mobile terminal.

Another problem is that, in order to correct a strong curling tendency, it is necessary to increase the slope or angle of the first guide surface. When the roll paper has a small diameter, it is necessary to use an angle of close to 90 degrees or above. To place the first paper guide upright and discharge the roll paper in a state where the printed surface appears as the surface and the paper does not cover the surface of a mobile terminal, the print head has to be arranged horizontally above the feed roller. This arrangement is not preferable since the print head has to be removed when setting the roll paper and when there is a paper jam.

These problems are solved by guiding the inner surface of the roll paper, which is fed by the feed roller, by the first guide surface so that the discharge direction of the roll paper is changed to the outer surface. Since the roll paper is bent in the opposite direction to the direction of curving due to the curling tendency, the curl becomes easy to remove. Also, since the roll paper discharged to the supply direction of the roll paper, the roll paper is outputted without covering the screen of the mobile terminal. In addition, the inner surface appears as the surface of the discharged roll paper, so that by printing on the inner surface, it is possible to output the paper with the printed surface on the front. In this printing apparatus, since the roll paper is discharged to the direction in which the roll paper is supplied, the feed roller can be disposed on the roll paper side with respect to the print head, so that the feed roller (for example, the platen roller) can be arranged removable, not the print head, for changing the roll paper.

Accordingly, in a printing apparatus equipped with the paper feeding apparatus of the present invention, it is preferable for a paper pass or route that leads the inner surface of the roll paper to the print head to be provided. The inner surface of the roll paper is guided by the first guide surface to discharge the roll paper towards the outer surface. The feed roller is arranged so as to contact the outer surface of the roll paper and feed the roll paper towards the first guide surface. Accordingly, when a thermal head is used as the print head, roll paper with a thermosensitive surface on the inner surface is used.

By providing a cutter for cutting the roll paper into a desired size, it is possible to obtain print outs that have no curling tendency, that have been cut into the desired size, and that can be handled in the same way as pre-cut sheets. If a movable blade is disposed between the first paper guide and the feed roller, the paper feeding amount for cutting the roll paper is reduced. By cutting the roll paper upstream on the first guide surface, counter curling tendency at the first guide surface is more reliably prevented. The second guide surface can be used to control the distance between the print head and the cutter, so that it is easy to provide enough space for arranging the cutter.

When the roll paper is cut by a movable blade and a fixed blade, it is preferable for the movable blade to be disposed on the outer side to the roll paper, that is, above the feed roller and/or on the discharge side so as to make the movable blade easy to remove. On the other hand, it is preferable for the fixed blade to be disposed on the print head side and on an opposite side of the first paper guide to the movable blade, that is, below and/or on the paper feeding side. Even when the printing apparatus stops due to a paper jam or the like with the movable blade having moved and being positioned above the fixed blade, the fixed blade does not obstruct the removal of the movable blade.

As mentioned, in a printing apparatus that prints on the inner surface, it is easy to arrange the first paper guide, the movable blade and the feed roller removable from the main body of the printing apparatus. When the first paper guide, the movable blade, and the feed roller are removable from the main body, the entire paper route appears, so that it is extremely easy to set the roll paper, and it is also simple to remove paper jams. The first paper guide, the movable blade, and the feed roller become removable with a roll paper cover that opens and closes with respect to the main body when the roll paper is attached. Simply opening the roll paper cover exposes the entire paper route, setting the roll paper and dealing with paper jams become much easy. If the first paper guide has the roll paper discharged in the direction of the roll paper cover, the surface of the roll paper cover can be used as a stocker.

BEST MODE FOR CARRYING OUT THE INVENTION

Figure 1:
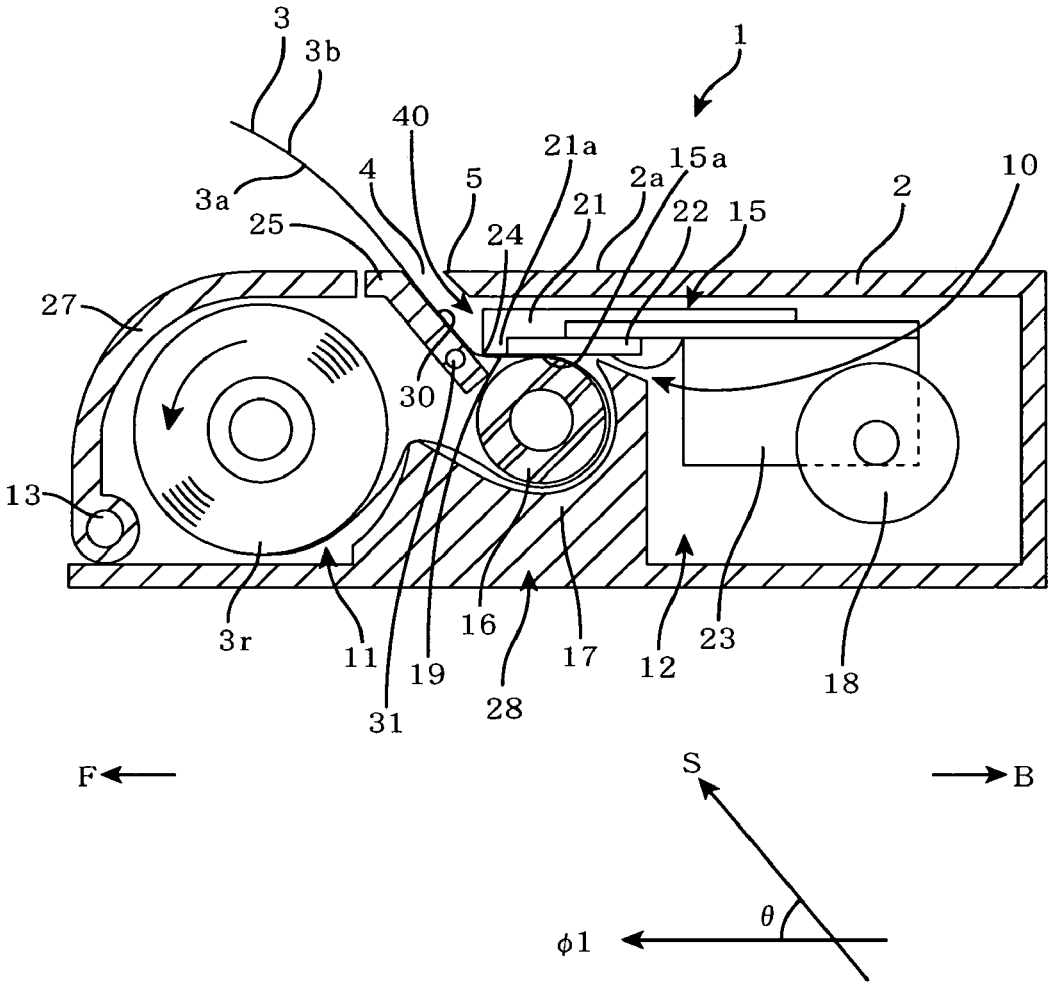
FIG. 1 is a cross-sectional view showing the overall construction of a printer according to the present invention.

The following describes the present invention in more detail with reference to the attached drawings. FIG. 1 is a cross-sectional view showing a printer (printing apparatus) according to the present invention in outline, in a state where a housing 2 has been cut on a side surface thereof. This printer 1 is a thermal printer. The printer 1 has a line thermal head 15 and a platen roller 16 for nipping and feeding and prints onto thermosensitive roll paper 3. This printer 1 is arranged in a box-shaped housing 2 and a total thickness is almost 15 mm. The housing 2 includes a paper storage unit 11 for the roll paper 3 at one side (the front) F. The housing 2 is divided into a roll paper cover 27 that covers the upper part of the paper storage unit 11 and a part that forms a main body 28 of the printer 1. The cover 27 is attached to the main body 28 via a hinge 13 so that the cover can be opened and closed. When the cover 27 is opened to the front, roll paper (a roll paper unit) 3*r* that has a width of around 105 mm and a diameter of around 12 mm can be set.

The back side B of the housing 2 is a part 12 where printing is performed on the roll paper 3 and encloses a printing mechanism 10 that comprises the line thermal head 15 and the platen roller 16 and other printing-related mechanisms, such as a motor 18 for driving the platen roller 16 and a control panel 23. After the roll paper 3 supplied from the paper storage unit 11 has been printed upon by the printing mechanism 10, the roll paper 3 is outputted to the outside from a discharge opening 4 provided in the upper part or an upper wall 2*a* of the housing 2. A manual cutter 5 is provided at the discharge opening 4. By manually cutting the outputted roll paper 3, print outs in the form of cut sheets of A6 size (105 mm by 148 mm) are obtained. Although not illustrated, the printer 1 has a suitable interface, such as a USB interface or an infra red interface, for receiving printing data and control data from a host, which can be a mobile phone or mobile computer, such as a PDA, or a desktop personal computer.

When the printer 1 is set so as to the discharge opening 4 being located at the top, the line thermal head 15 and the platen roller 16 are arranged up and down. The platen roller 16 has a highly frictional outer circumferential surface that is made of rubber or the like, and reliably feeds the roll paper 3 with the roll paper 3 being held or nipped between the line thermal head 15 and the platen roller 16. A feed guide 17 is provided below and behind the platen roller 16 and leads the roll paper 3, which has been supplied from the paper storage unit 11 at the front F, below the platen roller 16. The roll paper 3 moves by around 180 degrees around the platen roller 16, changes the direction and leads to the line thermal head 15. An outlet guide 25, which has a guide surface (first guide surface) 30 that extends diagonally upwards from the periphery of an output side of the platen roller 16, is disposed at the discharge opening 4. The line thermal head 15 is equipped with a head part 22 that has a printing surface 15*a* for performing printing by heating the roll paper 3, and is disposed at a position contacting the platen roller 16. Also, a plate part 21 extends towards the discharge opening 4 from the head part 22, with a tip or end part 21*a* of the plate part 21 reaching a vicinity of or a point close to the guide surface 30.

Figure 2:
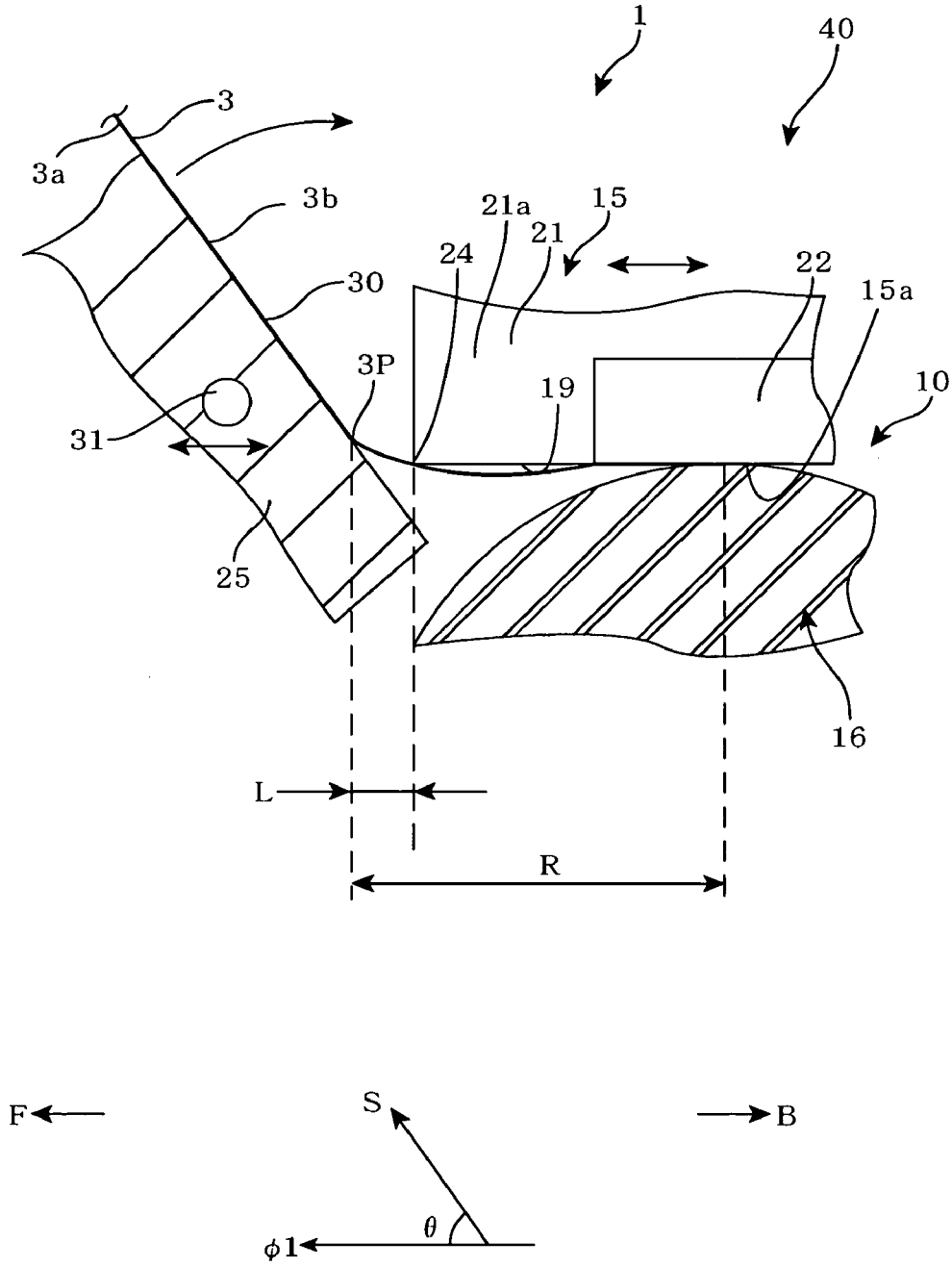
FIG. 2 shows an enlargement of a part that composes the paper feeding apparatus of the printer shown in FIG. 1.

FIG. 2 shows an enlargement of the relationship between the line thermal head 15, the platen roller 16 and the outlet guide 25. The line thermal head 15 and the platen roller 16 feed the roll paper 3 along a downward surface (second guide surface) 19 of the plate part 21 of the line thermal head 15 in the front direction F (a first direction ($\phi 1$). The roll paper 3 strikes the guide surface 30 of the outlet guide 25 and is bent upwards along the slant of the guide surface 30, and then the paper 3 is outputted from the exit opening 4. The slant S (an angle $\theta$ in the clockwise direction with respect to the first direction $\phi 1$) of the guide surface 30 is tilted so as to bend the roll paper 3 in an opposite direction to the direction of curl. In the present embodiment, the slant S is tilted by around 50 degrees in the clockwise direction with respect to the first direction $\phi 1$ in which the roll paper 3 is conveyed. Accordingly, a point or part 3P of the roll paper 3 that strikes the guide surface 30 is bent in the opposite direction to the direction in which the roll paper 3 is curled and an inside of the curled part is stretched or extended. Accordingly, the curve due to the curling tendency is removed and the roll paper 3 is outputted from the exit opening 4 as flat continuous paper. Therefore, by cutting the roll paper 3 into a predetermined size such as A6 using the cutter 5, it is possible to obtain the same print outs as pre-cut sheets of the desired size using roll paper 3.

In the printer 1, a paper feeding apparatus 40 of the present invention is arranged by the platen roller 16, the thermal head 15, and the outlet guide 25 and by those parts the printing mechanism 10 is also arranged. That is, the platen roller 16 corresponds to a feed roller, the thermal head 15 corresponds to a paper holding member, and the outlet (discharge or output) guide 25 corresponds to a first paper guide that has a first guide surface. Also, in the thermal head 15, the tip part 21*a* of the plate part 21 that extends towards the guide surface 30 on the output side of the thermal head 15 corresponds to a second paper guide. This means that the line thermal head 15 also functions as a third paper guide in which the paper holding member and second paper guide are integrated.

The guide surface 30 having the slant S tilted so that the roll paper 3 is bent in the opposite direction of the bent of the roll paper 3 is enough for de-curling the roll paper 3. However, according to experiments by the inventors of the present application, if the slant S of the guide surface 30 is tilted by 45 degrees or above with respect to the first direction $\phi 1$ in which the roll paper 3 strikes the first guide surface 30, the curl of the roll paper 3 becomes reliably removed, and print outs becomes in an approximately flat state. Accordingly, in order to obtain print outs that can be handled in the same way as regular cut sheets, the angle $\theta$ of the slant S of the first guide surface 30 should preferably be 45 degrees or above with respect to the first direction $\phi 1$.

When there is no special paper guide to guide the roll paper 3 to the guide surface 30, it is important for the first guide surface 30 to be disposed close to the platen roller 16 that functions as the feed roller, and the arrangement that the distance R between the platen roller 16 and the first guide surface 30 is 10 mm or below is preferable. As described below, this distance can be extended by disposing a suitable paper guide. In the paper feeding apparatus 40 of the present invention type, even if the roll paper 3 may be bent somewhat due to its own curling tendency, the roll paper 3 is led in an approximately linear manner to the first guide surface 30 using the rigidity of the roll paper itself. At the point (3P in the drawing), the paper 3 strikes the first guide surface 30 and the paper 3 is bent with stretching and/or extending sharply in the opposite direction to the curling tendency, so that the curl is removed. The inner surface 3*a* of the curled roll paper 3 is pressed or pushed onto the guide surface 30 and is forcibly bent in the opposite direction to the curl, so that the inner surface 3*a* extends or being stretched and the outer surface 3*b* contracts or shrinks, so that it is believed that the imbalance in the inner stress of the roll paper 3 that causes the curling tendency is removed and the curl is removed extremely efficiently.

In order to suddenly change the angle of the roll paper 3 at the part 3P that strikes or contacts the first guide surface 30, the roll paper 3 should preferably be pushed against the guide surface 30 with sufficient force. To do so, it is important for the power of the platen roller 16 to be transmitted to the point 3P using the rigidity of paper itself (resistance to folding of the roll paper itself), so that it is important for the roll paper 3 to not bend or sag between the platen roller 16 and the guide surface 30. Accordingly, in the printer 1 of the present embodiment, it is preferable for the guide surface 30 to be disposed as close as possible to the platen roller 16 within a range that is tolerated due to layout and assembly considerations.

Since the roll paper 3 curls downwards, a force that pushes the roll paper 3 slightly downwards acts at the position 3P that the roll paper 3 strikes the first guide surface 30. This force acts as resistance against the guide surface 30 guiding the roll paper 3 diagonally upwards, so that the position 3P that strikes the first guide surface 30 becomes hard to slide upwards, which means that the state of the periphery of the striking position 3P is stabilized and the curl can be stably removed.

However, depending on the paper quality and/or condition of the roll paper 3, the position 3P that the roll paper 3 strikes the first guide surface 30 may move upwards along the first guide surface 30. In such a case, at the periphery of the position 3P, the angle between the guide surface 30 and the direction of the roll paper 3 striking the guide surface 30, which is the effective angle E, is reduced, so that it becomes uneasy to remove the curling tendency. In the printer 1, the tip part 21*a* of the plate part 21 in the line thermal head 15 that functions as the second paper guide extends to the close to the guide surface 30, so that the position 3P that the roll paper 3 is striking is stable and dose not move away upwards. Accordingly, the roll paper 3 is made resistant to folding and the paper feeding force is transmitted to the position 3P, so that the curling can be efficiently removed continuously. The distance L between the output tip or output end 21*a* of the second paper guide and the first guide surface 30 should preferably be set at 5 mm or below.

By making the corner 24 of the tip part 21*a* a right angle or an acute angle, the position 3P where the roll paper 3 strikes the guide surface 30 becomes more difficult to move upwards. This also maintains the direction of the roll paper 3 striking the first guide surface 30 at the first direction $\phi 1$ and the angle $\theta$ with the slant S of the guide surface 30. Also, the roll paper 3 tilts downwards somewhat at the position 3P due to the curl, so that the angle at which the roll paper 3 strikes the guide surface 30 is always larger than the angle $\theta$ between the guide surface 30 and the paper feeding direction $\phi 1$. Accordingly, the mechanism of this invention uses the curl itself conversely for easily removing the curling tendency of the roll paper 3.

From the view point of the platen roller 16, the paper feeding direction $\phi 1$ is decided as a direction of a tangent at the point where the thermal head 15 contacts the platen roller 16. However, by the angle of the tip part 21*a* of the plate part 21 that functions as the second paper guide, the angle of striking the paper to the guide surface 30 can be controlled and more preferable conditions for removing the curl can be produced or controlled. In the same way, by changing the slant of the first guide surface 30, the conditions for removing the curl can be changed.

In order to make rigid the roll paper 3 against the folding over, the distance R between the platen roller (feed roller) 16 and the first guide surface 30 and/or the distance L between the tip part 21*a* and the first guide surface 30 should preferably be made short. In order to efficiently remove the curl, the slant S of the first guide surface 30 with respect to the first direction $\phi 1$ and/or the angle $\theta$ should preferably be made large. However, if the roll paper 3 is pushed with too much pressure against the first guide surface 30 and/or if the angle of the roll paper 3 striking the first guide surface 30 (this angle being determined by the relative angle between the first guide surface 30 and the line thermal head 15 that forms the second surface) becomes too large, there is the possibility of a fall in the quality of the print outs due to the roll paper 3 being overly deformed, curling the opposite way and/or creases being produced in the roll paper 3, etc.

In the printer 1 of the present embodiment, a shaft 31 that extends parallel in the axial direction of the platen roller 16 is provided for the first paper guide 25, with the first paper guide 25 being able to rotate about this shaft 31. Using this shaft, the first output guide 25 can also slide in the forward and backward. Therefore, by moving the first paper guide 25 itself and/or operating the shaft 31 from the outside, the slant S of the first guide surface 30 and the distance L between the first guide surface 30 and the tip part 21*a* can be adjusted. When the strength of the curling tendency of the roll paper 3 changes due to the roll paper 3 being consumed and the diameter changing, or the paper quality of the roll paper 3 has been changed, the paper guide 25 can be set in a suitable state for removing the curl. In place of the first paper guide 25, the angle or position of the tip part 21*a* of the line thermal head 15 may be controlled.

In the printer 1 that includes the paper feeding apparatus 40, the curl can be removed by striking the roll paper 3 to the first guide surface 30 on the exit side of the platen roller 16. Accordingly, there is no need for the roll paper to be squeezed by a roller or spring to remove the curl and the resistance for feeding the roll paper is decreased. The load applied to the motor is reduced, and a motor 18 with a small output can be used, so that it is possible to make the housing 2 of the printer 1 compact. In addition, the power consumption of the motor 18 is reduced, so that it is possible to extend battery life.

When the curl was removed by squeezing with rollers or a spring, etc., it is necessary to pull the roll paper through such a mechanism, so that it has been necessary to locate the apparatus for de-curl between the roll of paper and the platen roller. With the method of the present embodiment, the curl is removed by striking the roll paper 3 to the first guide surface 30, so that the de-curling mechanism can be installed at the exit side of the platen roller, near the exit opening 4. Accordingly, it is easy to add a de-curl mechanism as an option and to add a de-curl mechanism to a conventional printer. In the printer 1, a mechanism for de-curling is realized by arranging according to the present invention, the output paper guide 25, the platen roller 16, and the line thermal head 15, those are the members that compose the periphery of the exit opening 4 of the thermal printer 1. This means that very few parts or members and very little space need to be added, so that the curl of roll paper can be removed in an extremely compact manner and at low cost.

For stretching out of the curl, it is thought that removing the tendency by extending the inner side of the curled part is important. In methods where the curl is removed while pulling the roll paper, since forces are applied to both the inner side and the outer side of the curled part, it is difficult to efficiently make the difference between these forces large. In the printer 1, the curl is removed while pushing the roll paper 3. Accordingly, it is possible to extend only the inner surface without applying an extending force to the outer surface of the curled part. In addition, using the folding resistivity of the paper, a compressing force that acts in a contracting direction can be generated in the outer surface of the curled part. Accordingly, this aspect of the paper feeding apparatus 40 and/or printing mechanism 10 of the printer 1 of the present embodiment is extremely efficient at removing the curl.

In addition, in the printer 1, the curl is removed on the output side near the platen roller 16 while the paper is being pushed and paper feeding is reliably performed in this area, so that there is also the merit that it is difficult for paper jams to occur. If the paper jam occurs, the paper jam is located near the exit opening 4, so it is easy to remove the jam.

So long as the platen roller 16 is not driven and paper is not fed, no force is applied to the part 3P of the paper that strikes the first guide surface 30. Accordingly, when printing by the printer 1 is interrupted and the platen roller 16 is not rotating, even if the roll paper strikes the guide surface 30 and bends in the opposite direction, very little force acts on that part 3P, so that no tendency to curl in the opposite direction is imparted. Accordingly, it is not necessary to perform special control, such as control to rotate the platen roller 16 in reverse for preventing the counter curl.

The paper feeding apparatus 40 according to the present invention and a printer that uses such paper feeding apparatus 40 are not limited to those described above. The printer may have a paper pass where the roll paper is not reversed at the platen roller. The discharge direction for the paper is not limited to the upper surface of the housing. The side surface or bottom surface may be freely selected and the first guide surface of the present invention can be arranged in any arrangement.

Figure 3:
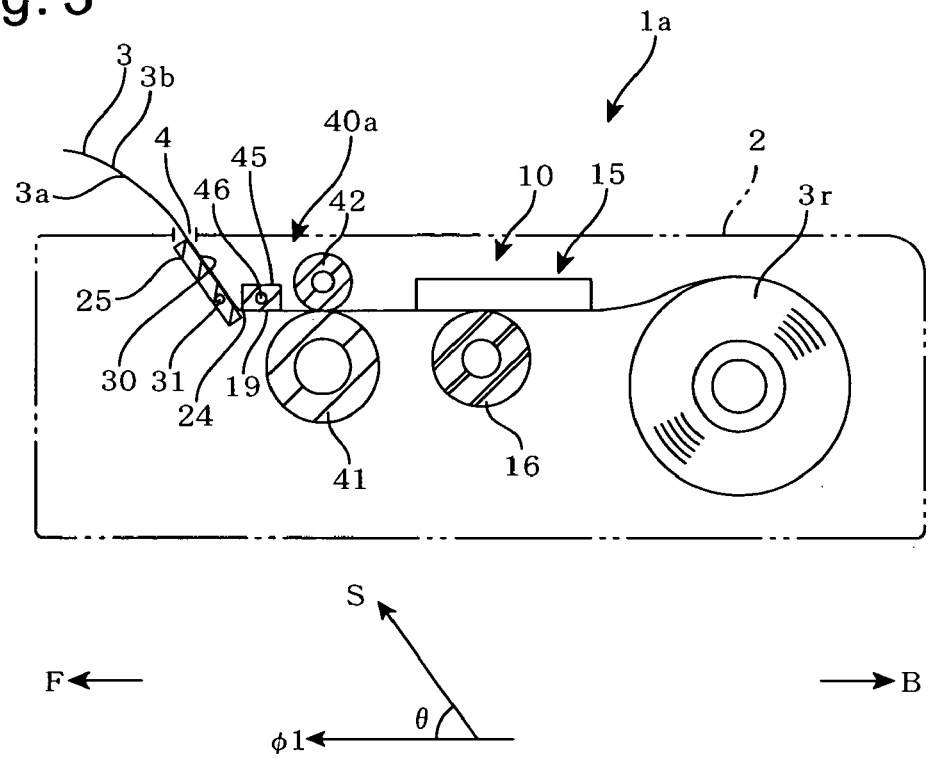
FIG. 3 shows an example of a printer with a separate second paper guide between the feed roller and the first paper guide.

The printer 1*a* shown in FIG. 3 is a different example of the present invention. In this printer 1*a*, the printing mechanism 10 and a paper feeding apparatus 40*a* have been separated. In this printer la, the roll paper unit (roll) 3*r* is set at the back B of the housing 2 and the roll paper 3 is fed towards the front F by a printing mechanism 10 including the line thermal head 15 and the platen roller 16, then the curl is removed by a paper feeding apparatus 40*a* that discharges the paper. The paper feeding apparatus 40*a* includes a discharge roller 41, a sub-roller 42, an outlet guide 25 that guides the roll paper 3 to the exit opening 4, and a paper guide 45 that leads roll paper 3 from the discharge roller 41 to the close of the outlet guide 25. The discharge roller 41 corresponds to a feed roller, the sub roller 42 corresponds to a paper holding member, and the output or outlet guide 25 corresponds to a first paper guide that includes a first guide surface 30. The paper guide 45 corresponds to a second paper guide that has the second guide surface 19.

In the paper feeding apparatus 40*a*, the outlet guide 25 is rotated and/or slid with the shaft 31, and the second paper guide 45 is also slid in the forwards-backwards direction and rotated with the shaft 46. Accordingly, the direction in which the roll paper 3 strikes the first guide surface 30 can be adjusted more freely, so that it is possible to appropriately correct curling tendencies of different conditions.

Figure 4:
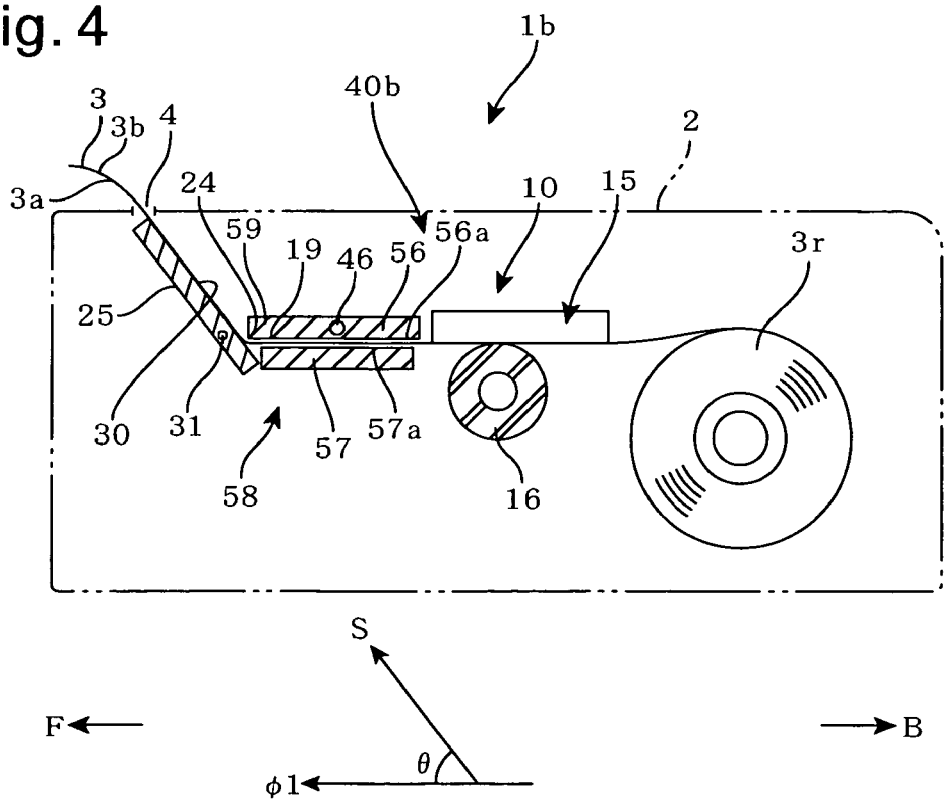
FIG. 4 shows an example modification of the printer shown in FIG. 3.

FIG. 4 shows yet another example. A printer 1*b* of this example includes a paper feeding apparatus 40*b*. The paper feeding apparatus 40*b* includes a fourth paper guide 58 that has guide surfaces 56*a* and 57*a* that face one another in order to lead the roll paper 3 from the output side of the platen roller 16 to the first guide surface 30. Additionally, out of two members 56 and 57 disposed up and down of the fourth paper guide 58, a part 59 on the output side of the upper member 56 is disposed at a closer position to the first guide surface 30 so as to be the second guide surface 19.

In the paper feeding apparatus 40*b*, the roll paper 3 that has been outputted from the platen roller 16 is linearly guided to the first guide surface 30 inside a tiny space between the guide surfaces 56*a* and 57*a*. Accordingly, even if the distance between the platen roller 16 and the first guide surface 30 is increased, the roll paper 3 can be prevented from folding without sagging. Accordingly, the force that has fed the paper push the roll paper 3 against the first guide surface 30, so that the same situation is made as above, the curl is stably removed from the roll paper 3. This construction is suited to adding a function of the present invention for removing the curl to an existing printer or to a printer in which the first guide surface 30 cannot be disposed near the platen roller 16. As one example, it is possible to lead the roll paper 3 to an existing housing wall or to the outside by the two members 56 and 57 and arrange the first guide surface 30 for de-curling.

In the paper feeding apparatus 40*b*, the first paper guide 25 and the bottom member 57 of the fourth paper guide 58 may be integrated. With the shaft 46, the upper member 56 of the fourth paper guide 58 is rotated and/or slid for controlling the angle and position of the part 59 of the exit side that functions as the second paper.

Figure 5:
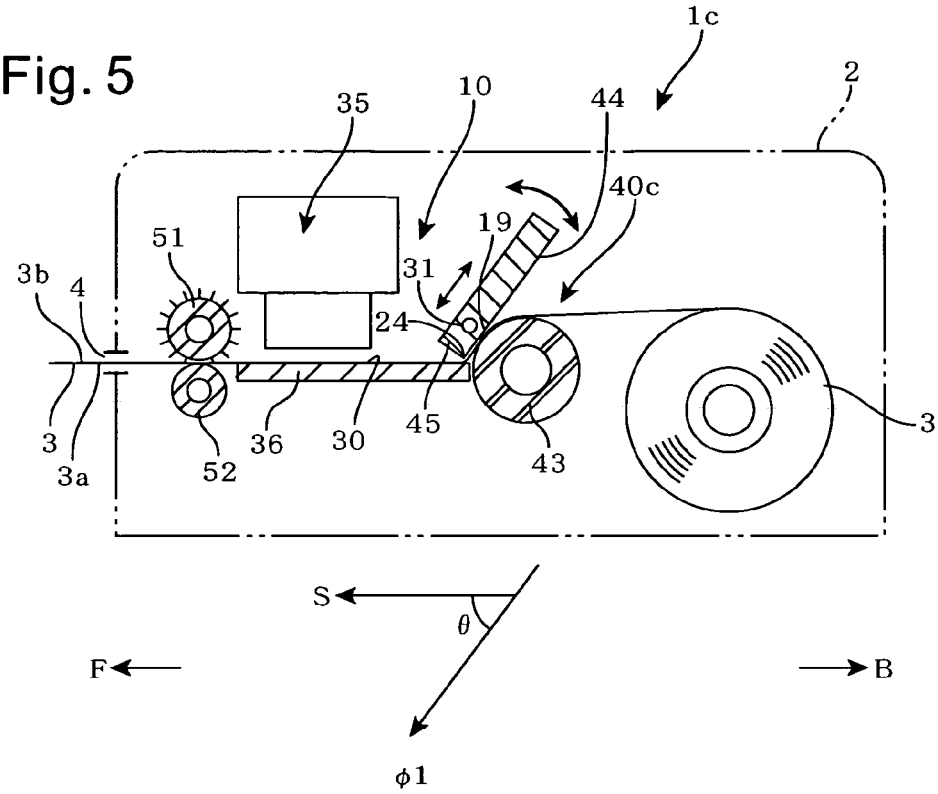
FIG. 5 shows another example of a printer of the present invention.

FIG. 5 shows yet another printer 1*c* according to the present invention. This printer 1*c* has a paper feeding apparatus 40*c* of the present invention installed upstream of the printing mechanism 10. In this printer 1*c*, the roll paper 3 is led to a flat platen 36 by the paper feeding apparatus 40*c* and a print head, such as an ink jet head 35, that is opposite the flat platen 36 and moves in the scanning direction prints on the roll paper 3. Alternatively, the head 35 may be a wire-dot type. Also, in place of a serial printer in that printer head moves in the scanning direction, the printer may be a line printer that prints entire line at ones or a page printer such as a laser printer. The printed roll paper 3 is guided to the exit opening 4 by discharge rollers 51 and 52.

The paper feeding apparatus 40*c* of the present example includes a feed roller 43, a paper guide 44 that is the paper holding member and also the third paper guide, and a flat platen 36. The flat platen 36 corresponds to the first paper guide. A part on the output side 45 of the paper guide 44 corresponds to the second paper guide that includes the second guide surface 19. The curl of the roll paper 3 fed by the feed roller 43 and the plate 44 is removed on the flat panel 36, so that printing can be performed on flat paper using an ink jet method or the like. Accordingly, high-quality printing can be performed even on roll paper. When an ink jet method is used, it is hard to hold and feed the paper in a state where the ink has not dried after printing for de-curl, though there are no such worries with the arrangement in the present example. In addition, the print quality can be raised. Since the paper feeding apparatus 40*c* is constructed on only the paper feeding side B of the ink jet head 35, problems such as deterioration in print quality due to the paper feeding apparatus 40*c* dirtying the surface of roll paper 3 that has been printed upon do not occur.

In the paper feeding apparatus 40*c* of the present embodiment, the plate 44 is slid in a diagonal direction, so that the distance between the plate 44 and the flat platen 36 can be controlled. By rotating the plate 44, the angle at which the roll paper 3 is bent at a surface (the first guide surface) 30 of the flat platen 36 can be adjusted.

Figure 6:
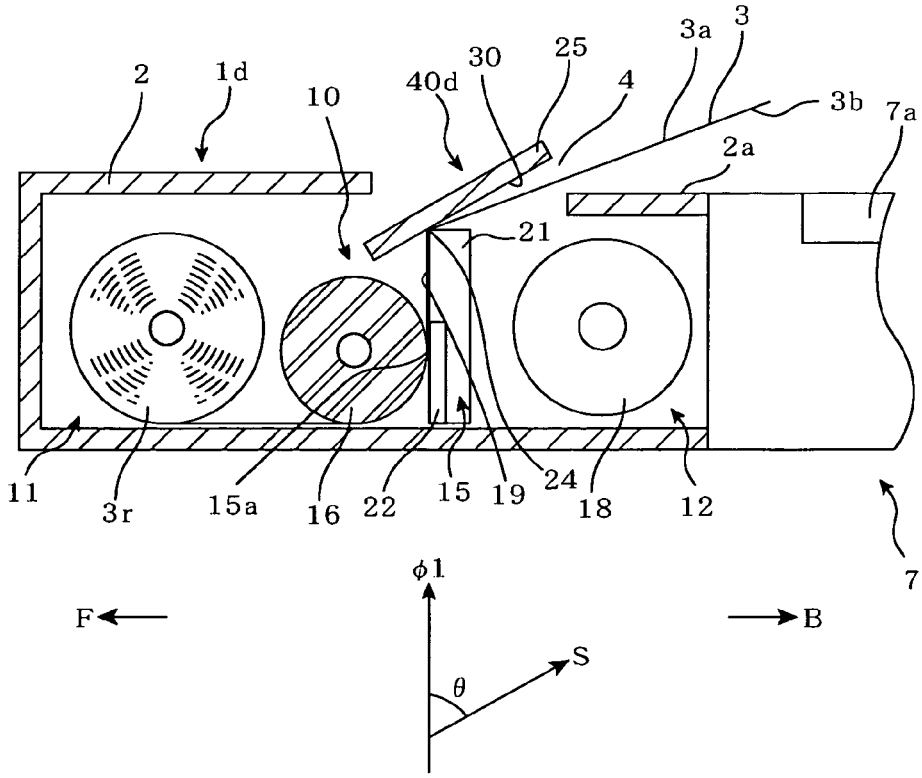
FIG. 6 shows yet another example of a printer of the present invention.

FIG. 6 shows yet another printer 1*d* according to the present invention. This printer 1*d* is equipped with a paper feeding apparatus 40*d* which removes the curl in the same way as in the printer 1 shown in FIG. 1, and in which the thermal head 15 is used as a paper holding member and the platen roller 16 is used as a feed roller. The roll 3*r* or paper, the platen roller 16, and the thermal head 15 are aligned in that order, the thermal head 15 is disposed so as to be approximately vertical, so that the platen roller 16 can be moved upwards and removable, and when the platen roller 16 has been removed, the entire paper route appears, so that it is easy to set the roll paper and to remove paper jams, thereby making the printer easy to handle.

Figure 7:
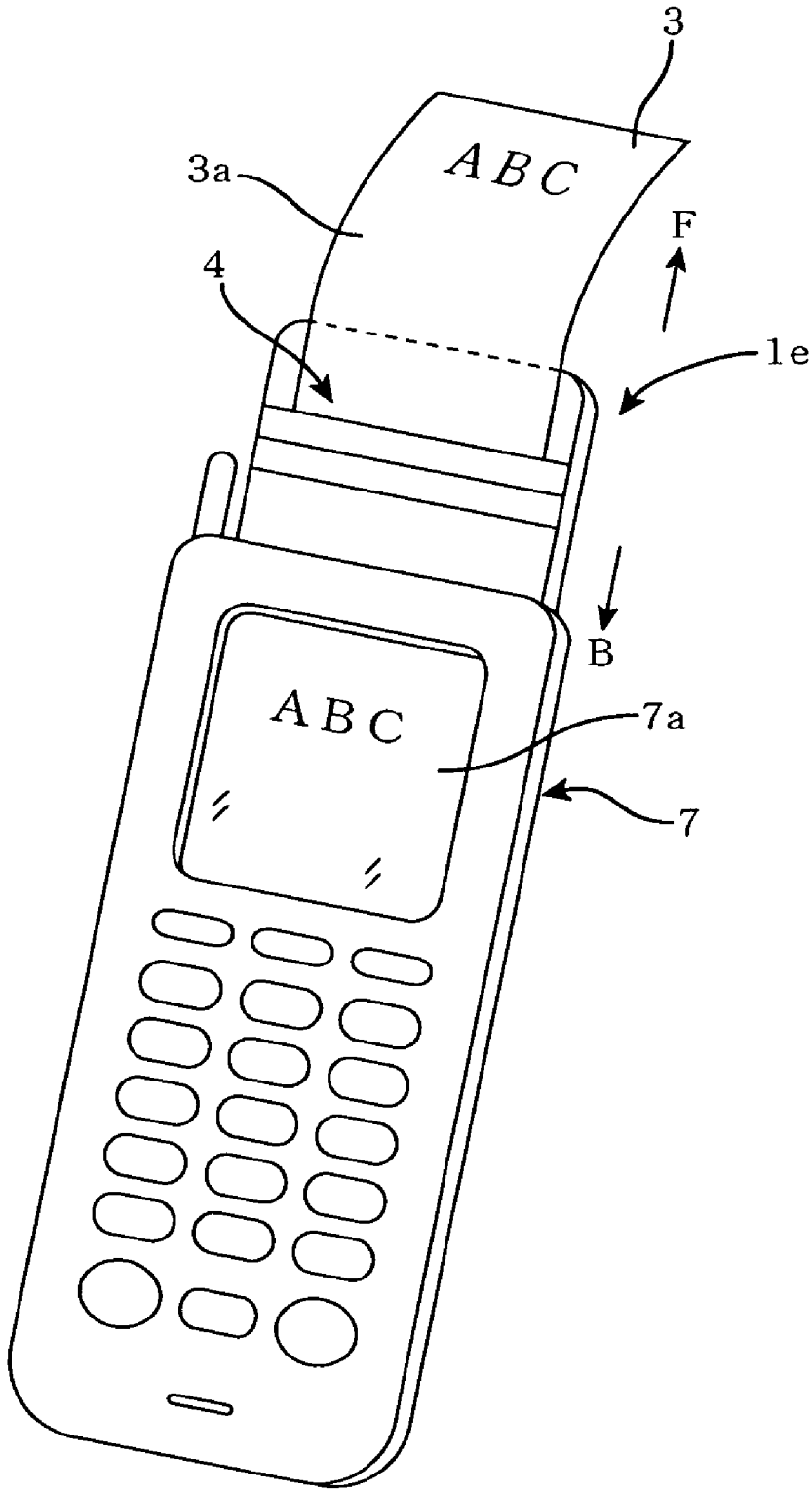
FIG. 7 shows a printer according to the present invention that prints on an inner surface of roll paper and has been installed in a mobile terminal.

However, in the printer 1*d*, the roll paper 3 is discharged on the opposite side to the supply direction with the printed surface 3*b* on the reverse or facing downwards. It is undesirable that the printed surface is not visible. Also, in view of when the printer is installed with a mobile terminal 7 such as that shown in FIG. 7, it is not preferable for the paper 3 that has been discharged to cover and hide a liquid crystal panel 7*a* and a keyboard. When the printer is installed in or with the mobile terminal 7, as shown in FIG. 7, it is preferable for the print surface 3*a* to be visible and for the liquid crystal 7*a* to not be hidden by the print outs.

The higher the angle θ of the first guide surface 30 with respect to the direction φ1 in which paper is fed by the platen roller 16, the greater the curl-removing performance. In particular, when a diameter of roll paper 3 is so small such as 10 mm or below, the roll paper 3 has strong curl, so that the angle θ should preferably be large, and maintain an angle of 45 degrees or above. Considering an arrangement in which such angle θ is maintained, the print surface is made visible, and the discharge direction is on the roll paper side, the arrangement shown in FIG. 1 is unavoidable where the thermal head 15 is arranged horizontally above the platen roller 16. However, this arrangement is not so good considering how to remove the platen roller 16. Therefore, an automatic paper feeding mechanism to the platen roller or an opening or openings for removing paper jams may be required. While this may be acceptable for a slightly large printer, such as a desktop printer, for an extremely compact printer that can be installed with a mobile phone, the other solution is required for easily handle.

Figure 8:
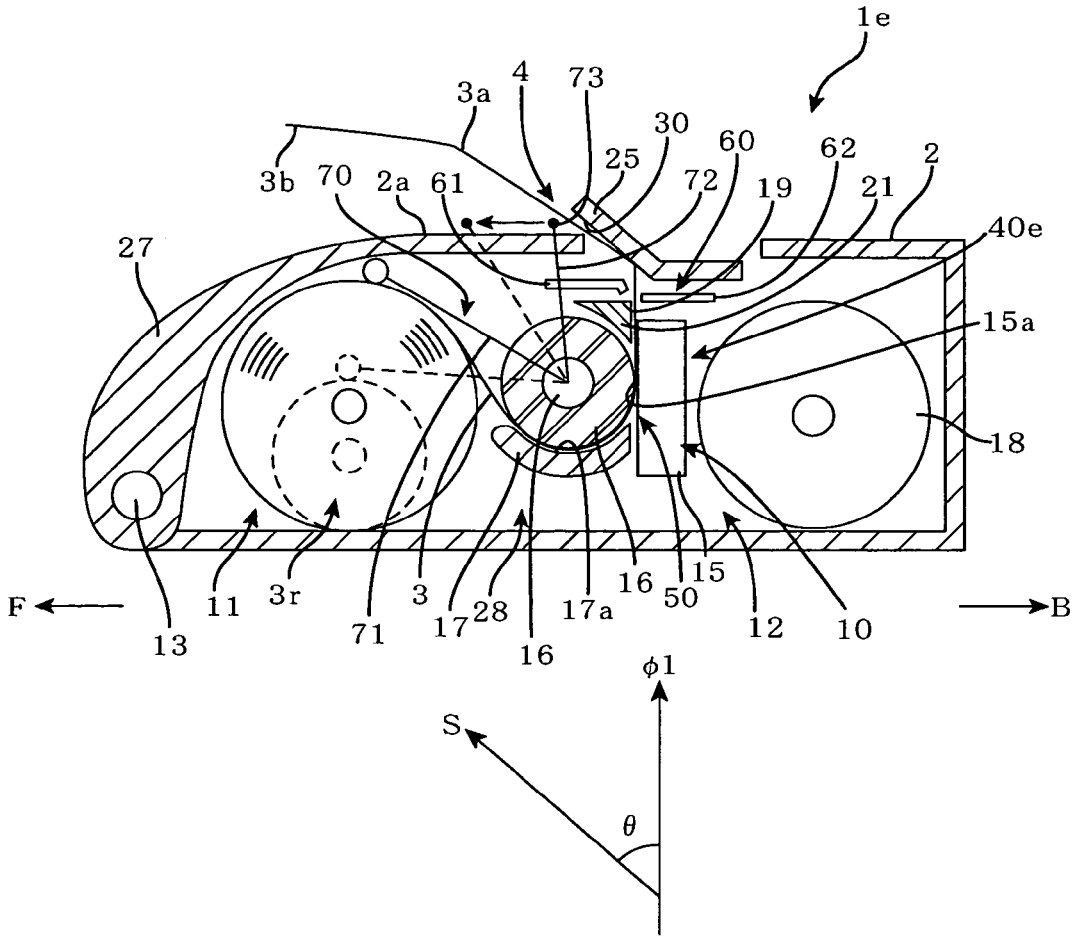
FIG. 8 is a cross-sectional view showing the overall construction of the printer shown in FIG. 7.

In FIG. 8, a cross-sectional view shows the overall construction of yet another printer 1*e* according to the present invention. The printer 1*e* is shown with a similar size to the examples described above, however is an extremely small printer that uses a paper roll 3*r* with a diameter of 10 mm or below and outputs flat print outs with the curl removed. Inside the housing 2, the paper roll 3*r*, the platen roller 16, the thermal head 15, and the motor 18 that drives the platen roller 16 are arranged in an approximately straight line or are aligned almost horizontally. A paper guide 17 with a U-shaped guide surface 17*a* is disposed below the platen roller 16, and a paper pass 50 is constructed. In the paper pass 50, paper 3 pulled from the paper roll 3*r* leads around the outer circumference of the platen roller 16 and the reverse side of the paper 3 is outputted so that an inner surface 3*a* of the roll paper 3 faces the printing surface 15*a* of the thermal head 15. The thermal head 15 is disposed so that the printing surface 15*a* is approximately vertical, and the printed roll paper 3 is fed by the thermal head 15 and the platen roller 16 in an approximately vertical direction and is outputted to the outside from the exit opening 4 provided in the upper part of the housing 2.

A discharge paper guide (the second paper guide) 21 that includes a guide surface (the second guide surface) 19 for guiding the roll paper 3 from the platen roller 16 in the vertical direction, a cutter 60 that includes a movable blade 61 and a fixed blade 62, and an outlet guide (first paper guide) 25 that includes a guide surface (first guide surface) 30, which is tilted so as to guide the inner surface 3*a* of the roll paper 3 and bend the discharge direction towards the outer surface 3*b* of the roll paper, are disposed between the platen roller 16 and the discharge opening 4 in that order from below. The outlet guide 25 is disposed so as to appear on the surface 2*a* of the housing 2 and cover the discharge opening 4. In the printer 1*e*, the paper feeding apparatus 40*e* comprises the line thermal head 15, the platen roller 16, the first paper guide 25, and the second paper guide 21, so that the curling tendency (curl) of the roll paper 3 is removed by the roll paper 3 being pushed against the guide surface 30 located at the discharge opening 4 and the paper is discharged to the surface 2*a* of the housing 2.

The movable blade 61 and the fixed blade 62 of the cutter 60 are disposed in parallel along the surface of the housing 2 just below the output guide 25. The movable blade 61 of the cutter 60 is positioned above the platen roller 16, so that the movable blade becomes the upper blade with respect to the fixed blade 62 that is positioned on the opposite side above the line thermal head 15, and moves perpendicular to the roll paper 3 in the horizontal direction. Accordingly, the discharged roll paper 3 is cut directly below the outlet guide 25, and print outs are discharged in the form of flat sheets where the curl has been straightened out.

The discharge paper guide 21 is positioned above the platen roller 16, and functions as the second paper guide of the paper feeding apparatus described above by contacting the outer surface 3*b* of the roll paper 3 and guiding the roll paper 3 in an approximately straight line to the vicinity of the movable blade 61 from the platen roller 16 without folding the roll paper 3.

In addition, the printer 1*e* includes a means 70 that operates in accordance with the diameter of the paper roll 3*r* and indicates a position of the outlet guide 25. The indicator 70 includes two arms 71 and 72 that rotate around a shaft 16*a* of the platen roller 16, with the arm 71 contacting the outer circumference of the roll paper unit 3*r* and detecting the diameter of the roll 3*r*. A front end 73 of the other arm 72 appears at the surface 2*a* of the housing 2 and rotates in coordination with the arm 71 so that a value corresponding to the diameter of the roll 3*r* is indicated by the front end 73 of the arm 72. Accordingly, the extent of the curl that changes according to the diameter of the roll 3*r* can be easily understood at the surface of the housing 2, so that the user can adjust the position of the outlet guide 25 to a position that is suited to removing the curl.

Figure 9:
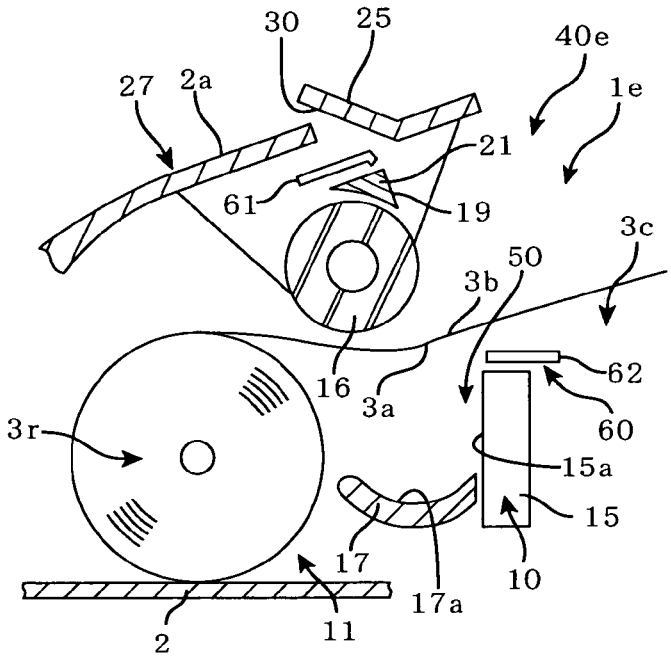
FIG. 9 shows the printer shown in FIG. 7 in a state where the roll paper cover has been opened.

FIG. 9 shows how the paper roll paper 3*r* is set. In the printer 1*e*, the platen roller 16 and the thermal head 15 are disposed in the horizontal direction (the first direction) from the side of the roll 3*r*. The printing surface 15*a* of the line thermal head 15 is arranged so as to extend upwards (vertically, or in a second direction that is perpendicular to the first direction) at approximately a right angle to the horizontal direction, and so does not interfere with the platen roller 16 when the platen roller 16 is moved away upwards. The platen roller 16 can be removed or moved away towards a side above the printer main body 28 without obstruction of the line thermal head 15.

The platen roller 16, the discharge guide 21, the movable blade 61, and the outlet guide 25 are attached to the roll paper cover 27 appropriately. When the roll paper cover 27 is rotated in order to set the roll 3*r*, the platen roller 16, the discharge guide 21, the movable blade 61, and the outlet guide 25 move together with the roll paper cover 27 so that the paper storage unit 11 and the paper pass 50 appear. Accordingly, as shown in FIG. 9, the roll 3*r* is inserted in the paper storage unit 11 and by pulling out the end part 3*c* from the upper part of the roll 3*r* with the inner surface 3*a* facing the direction of the paper pass 50 below, the roll paper 3 can be set in the printer 1*e* extremely easily.

Figure 10:
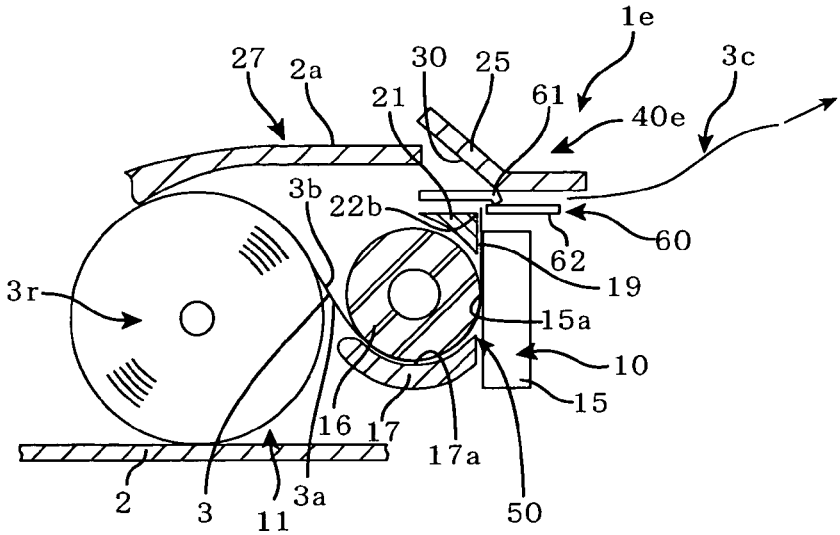
FIG. 10 shows the printer shown in FIG. 7 in a state where the roll paper cover has been closed after the roll paper has been set.

That is, after the roll 3*r* has been inserted into the storage unit 11 and the paper cover 27 has been closed, as shown in FIG. 10 the platen roller 16 returns to the position above the feed guide 17, the outer surface 3*b* of the roll paper 3 is pressed by the platen roller 16 and the roll paper 3 is nipped between the feed guide 17 and the platen roller 16. By doing so, the roll paper 3 is set in the U-shaped paper route 50 along the guide surface 17*a* of the feed guide 17. The reverse side of roll paper 3 is led by the paper route 50 and the inner surface 3*a* is guided towards the printing surface 15*a* of the thermal head 15, so that printing is performed on the inner surface 3*a* of the roll paper 3.

Once the roll paper 3 that has been pulled from the roll 3*r* has been set, the end part 3*c* of the roll paper 3 that is pulled passes above the fixed blade 62 and extends in the opposite direction to a normal discharge direction, the normal discharge direction is the direction to the roll 3*r*. After the roll paper cover 27 has been closed, the cutter 60 is operated, and the movable blade 61 moves and the end part 3*c* is cut off. Accordingly, in the printer 1*e*, by simply opening the roll paper cover 27, inserting the roll paper unit 3*r*, pulling out the end part 3*c* of the roll paper 3 so as to extend beyond the paper route 50, closing the roll paper cover 27, and by having the cutter 60 move once, the roll paper 3 is set in a state where printing is possible. Accordingly, the task of replacing the roll paper and putting the printer 1*e* into the standby mode is extremely easy.

After the roll paper 3 has been set, the roll paper 3 is inside the U-shaped paper pass 50 and the end of the roll paper 3 is positioned upstream of the cutter 60, and is in approximately straight. The end of the roll paper 3 is not pushed onto the outlet guide 25, so that the end of the roll paper is not significantly curved or folded and no tendency to bend in the opposite direction to the curl is imparted, so that there is no deterioration in the quality of the paper.

Figure 11:
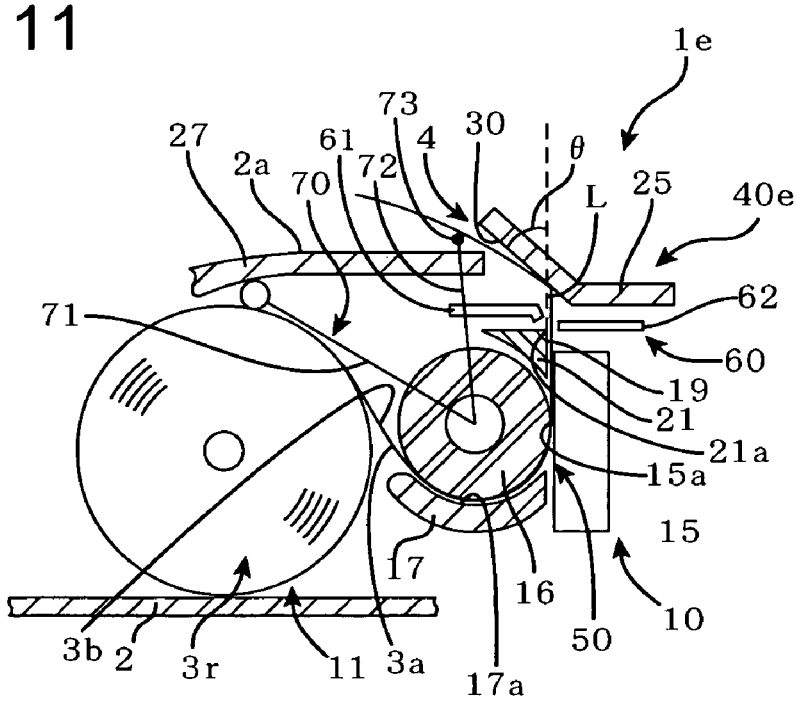
FIG. 11 shows how printing is performed on roll paper with a large diameter.

FIG. 11 shows how to print the roll paper 3. When print data is supplied to the line thermal head 15 and the platen roller 16 is moved by the motor 18 via a suitable driving mechanism such as a gear train or the like. The roll paper 3 is held between the line thermal head 15 and the platen roller 16 and fed upwards while printing is performed on the inner surface 3*a*. The printed roll paper 3 is led to the guide surface 30 of the output guide 25 through the cutter 60 with the outer surface 3*b* being guided in an approximately straight manner by the guide surface 19 of the discharge guide 21. The inner surface 3*a* of the roll paper 3 strikes the guide surface 30, and the roll paper 3 is bent by the angle of the guide surface 30 by the guide surface 30 in the direction to the outer surface 3*b* of the roll paper 3, that is, the opposite direction to the curling tendency or curl, and is discharged from the discharge opening 4 in the direction of the roll paper cover 27.

In the paper pass 50, the roll paper 3 is bent so that the outer surface 3*b* is placed on the inside, the platen roller 16 presses the outer surface 3*b* and the roll paper 3 is guided in an approximately U-shape. That is, the roll paper 3 is also bent in the opposite direction to the curl inside the paper route 50. Accordingly, so long as the curling tendency of the roll paper is not strong, the curl becomes somewhat weak by the paper pass 50. When the diameter of the platen roller 16 is small, the ability to weaken the curling tendency may be increased by reduced radius of curvature of the paper pass 50. However, with this U-shaped paper route 50 alone, there is not such a pronounced weakening effect for the curl. In the small printer 1*e*, the diameter of the roll paper 3 set in the printer is also small, so that the curl is so stronger. Accordingly, just after the paper has been fed from the platen roller 16, the curl is little weakened, so that the roll paper 3 at that point will be curled with the outer surface 3*b* in a convex state.

In the printer 1*e*, the roll paper is guided from the paper route 50 to the outlet guide 25 without folding and with the paper being pushed so as to bend in the opposite direction to the curl, so that print outs that are approximately straight are obtained from the outlet guide 25. The discharge guide 21 is disposed at the exit of the platen roller 16, and between the platen roller 16 and the cutter 60, the outer surface 3*b* of the roll paper 3 is guided in an approximately straight manner by the guide surface 19 of the discharge guide 21. Accordingly, the roll paper 3 is prevented from becoming convex on the outer surface 3*b* side. Also, the end of the roll paper 3 catches on the fixed blade 62 after cutting by the cutter 60 and this acts as a guide so as to prevent the roll paper 3 from becoming curve to the inner surface 3*a* side. Accordingly, the roll paper 3 that is outputted from the platen roller 16 is guided in an approximately straight manner to the guide surface 30 of the outlet guide 25 that is disposed directly above the cutter 60. This means that in the same way as in the various examples described above, the curling tendency of the roll paper 3 is successively corrected by the guide surface 30, and paper in the form of flat sheets that are not curled is discharged from the discharge opening 4. At this point, the printed roll paper 3 exits in the direction of the outer surface 3*b* by the outlet guide 25, so that the roll paper 3 is discharged with the printed inner surface 3*a* oriented as the surface, so that the user can see the printed surface 3*a*.

The diameter of the roll paper to be set in the small printer 1*e* will be around 10 mm, the angle θ between the direction the roll paper 3 striking the guide surface 30 and the direction of the guide surface 30 shall be 60 degrees or above, with an angle of 70 to 80 degrees, for example, being even more preferable. When the diameter of the roll paper 3 is 10 mm or below, it is preferable for the angle θ to be as close as possible to 90 degrees or above. In addition, when the distance L cannot be made especially small, it is necessary to increase the angle θ. By increasing the angle at which the roll paper is bent towards the outside to around 110 degrees, it is possible to obtain a sufficient de-curl effect even if the distance L is not especially reduced.

In the printer 1*e*, the inner surface 3*a* of the roll paper 3 is printed, so that it is possible for the angle θ by which the roll paper bends to the outside to be set at 90 degrees or above. The angle θ can be increased within the tilting of the printing surface 15*a* of the thermal head 15 faces upward, and the platen roller 16 can be disposed above the printing surface 15*a*. By this kind of arrangement, the platen roller 16 can be removed upward without interfering with the thermal head 15, so that the roll paper or roll itself 3*r* can be set extremely easily. In such arrangement, since the roll paper 3 becomes slanted with respect to the direction in which the movable blade 61 moves, cutting ability is slight reduced. The movable blade 61 can be disposed so as to be perpendicular to the roll paper 3 but would end up being disposed at an angle to the surface of the housing 2 or the cover 27, which can reduce the space efficiency. In the printer 1*e* shown in FIG. 8, the roll itself 3*r*, the platen roller 16, and the head 15 are aligned in an approximately straight line in the horizontal direction, and the printing surface 15*a* of the head 15 rises almost vertically so as to be perpendicular to this arrangement, so that the movable blade 61 is arranged along the cover 27 and can move in a direction that is perpendicular to the feeding direction of the roll paper 3, with space being used extremely efficiently in this arrangement.

The angle θ and the distance L should preferably be adjusted in accordance with the strength of the curling tendency of the roll paper 3, but it may not be necessary to adjust according to the condition of the curl particularly so often. However, for a compact printer 1*e*, the roll paper unit 3*r* has a small diameter, and the amount of paper on the roll is small, so that paper is wounded to the minimum diameter as far as possible. Accordingly, there is an extremely large difference in the usable diameter of the roll 3*r* at the start and at the end of use.

Figure 12:
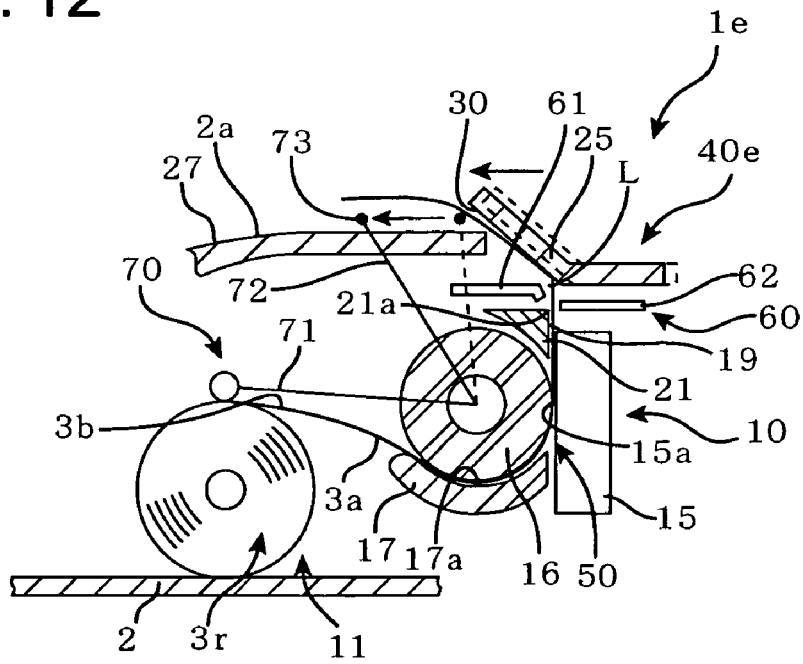
FIG. 12 shows how printing is performed on roll paper with a small diameter.

For the above reason, in the printer 1*e*, as shown in FIG. 12, the outlet guide 25 is attached to the housing 2 so as to slide in the front-back direction (the directions F and B in the drawing). Therefore, the position of the tilted guide surface 30 is changeable so that the distance L between the guide surface 30 and the end part 21*a* of the discharge guide can be adjusted. In addition, the indicator 70 that moves in the direction of the arrow in accordance with the diameter of the roll paper unit 3*r* is provided. Accordingly, the user can slide the outlet guide 25 in the front direction F or the back direction B based on the indication by the end 73 of the arm 72 of the indicator 70, and can thereby adjust the gap L to a suitable distance for removing the curling tendency.

The printer 1 is easy to maintain when a printer jam has occurred. That is, in the cutter 60, the movable blade 61 is disposed above the platen 16 and is also on the outlet guide 25 side of the fixed blade 62 so as to become the upper blade with respect to the fixed blade 62 that is disposed above the line thermal head 15. Accordingly, if a paper jam occurs when the movable blade 61 moves and the movable blade 61 and the fixed blade 62 are positioned above one another, the movable blade 61 can be released upwards without interfering with the fixed blade 62, as shown in FIG. 9, so that the paper jam can be removed. Furthermore, the movable blade 61 is arranged on the platen roller 16 side, and the discharge guide 21 and the output guide 25 are arranged so as to move together with the platen roller 16, so that when there is a paper jam, regardless of the state of the movable blade 61, the movable blade 61 can be moved without interfering with the other members and without the movable blade 61 and the platen roller 16 interfering with one another. Accordingly, in the printer 1*e*, even when a paper jam has occurred, the roll paper cover 27 can definitely be opened, so that the entire paper route 50 appears and paper jams can be easily removed.

After cutting, the end of the roll paper 3 is supported by the fixed blade 62 that is disposed above the line thermal head 15. Accordingly, as described above, the end of the roll paper 3 is guided approximately vertically and made to strike the guide surface 30 of the outlet guide 25 more precisely. By cutting the roll paper 3 upstream from the outlet guide 25, the amount of paper that needs to be fed in order to cut the roll paper 3 can be reduced, which can stop the roll paper from being wasted and can prevent the print region from being limited. In addition, by cutting the roll paper 3 with the cutter 60 that is disposed in front of (upstream from) the outlet guide 25, there is an additional merit in that the roll paper 3 is not pressed against the guide surface 30 until paper feeding is performed and a curling tendency in the opposite direction is not imparted into the roll paper 3.

The printer 1*e* is a roll paper printer, and when it is attached to a mobile terminal such as the mobile phone 7 and used, print outputs that do not curl can be outputted with the upward printed surface and without the display 7*a* or the keyboard of the mobile terminal being hidden. Additionally, the electric parts such as the line thermal head 15 and the motor 18 can be disposed on the side connected to the mobile terminal and the roll paper can be disposed on the side away from the mobile terminal so that the paper roll itself 3*r* is easy to replace and it is easier to provide a large space for storage. Accordingly, it is possible to provide a compact printer that is suited to being carried together with a mobile terminal, such as a mobile phone or a PDA, and to being used while the user is out of office.

In a case where the discharge guide 21 is omitted from the printer 1*e*, it is necessary to dispose the guide surface 30 of the output guide 25 in the vicinity of the platen roller 16, and in view of interference with the platen roller 16, the range of angle θ of the bending at the guide surface 30 becomes limited. Accordingly, it is preferable to provide the discharge guide 21 and to provide a suitable space between the platen roller 16 and the outlet guide 25, so that it possible to secure the angle θ for the guide surface 30. Also, the roll paper is guided in a straight line by the discharge guide 21, so that even if a reasonably large gap is provided for disposing the cutter 60, the roll paper 3 can be kept in a state where is difficult for the roll paper 3 to become folded over. The cutter 60 may be omitted, and the outlet guide 25 may be provided with a manual cutter function.

Also, in place of the indicator 70, it is possible to provide a link mechanism that can adjust the position of the outlet guide 25 in coordination with the diameter (remaining diameter) of the paper roll 3*r*, with it also being possible for the gap L to be adjusted automatically according to the diameter of the paper roll unit 3*r*. Furthermore, it is also possible to control the rate of removal of the curling tendency of the roll paper by changing the angle θ of the guide surface 30 in place of, or together with, control over the gap L as described above.

In addition, it is possible to print on the inner surface 3*a* of the roll paper 3 using a different method such as by an ink jet head. While examples of where the paper feeding apparatus of the present invention is installed in a thermal printer or an ink jet printer have been described above, so long as roll paper is used, the present invention is not limited to various printers and can be applied to other printing apparatuses, such as facsimiles and plotters.

INDUSTRIAL APPLICABILITY

As described above, the present invention provides a paper feeding apparatus and a printing apparatus that are extremely compact and can remove the curling tendency of roll paper. In this invention, by using roll paper, it is possible to realize a compact, handy-type printing apparatus that can be easily carried together with a mobile terminal such as a mobile phone, and can be used anywhere, with it also being possible to obtain print outs in the form of sheets. Accordingly, it is possible to provide, in addition to a desktop roll paper printer, facsimile machine, plotter, or copier, a printer that is suited to being installed in a mobile appliance, such as a mobile phone or PDA, and a printer that is also suited to being carried together with such a mobile appliance.

What is claimed is:

1. A paper feeding apparatus, comprising:

a feed roller and a paper holding member for nipping and feeding roll paper;

a first paper guide that has a first guide surface against which an inner surface of the roll paper outputted from the feed roller is pushed, the first guide surface being tilted so as to guide the roll paper in a direction opposite to a curving direction of the roll paper; and a second paper guide that has a second guide surface which leads the roll paper to the first guide surface with guiding an outer surface of the roll paper, an output end of the second guide surface being located in the vicinity of the first guide surface, wherein a part of the roll paper that strikes or contacts the first guide surface is bent sharply with an angle of at least 45 degrees in compressing condition for removing a curl of the roll paper.

2. A paper feeding apparatus according to claim 1, wherein the first guide surface is tilted by around 45 degrees or above with respect to a direction in which the roll paper strikes the first guide surface.

3. A paper feeding apparatus according to claim 1, further comprising a third paper guide in which the paper holding member and the second paper guide are integrated.

4. A paper feeding apparatus according to claim 1, further comprising a fourth paper guide that has guide surfaces which face one another so as to lead the roll paper from an output side of the feed roller to the first guide surface, wherein an output side of the fourth paper guide is the second paper guide.

5. A paper feeding apparatus according to claim 1, wherein a distance between the first guide surface and the output end of the second guide surface is 5 mm or shorter.

6. A paper feeding apparatus according to claim 1, further comprising means for adjusting an angle between the first guide surface and the second guide surface and/or a distance between the first guide surface and the output end of the second guide surface.

7. A paper feeding apparatus according to claim 6, further comprising means for indicating an adjustment amount for the means for adjusting in relation to a remaining diameter of the roll paper.

8. A paper feeding apparatus according to claim 6, wherein the means for adjusting adjusts in coordination with a remaining diameter of the roll paper.

9. A paper feeding apparatus according to claim 1, wherein a corner of a tip of the second paper guide is a right angle or an acute angle.

10. A printing apparatus including the paper feeding apparatus according to claim 1 and a print head for printing on the roll paper.

11. A printing apparatus according to claim 10, wherein the print head is a thermal head doubles as a paper feeding member, and the feed roller is a platen roller that together with the thermal head nips and feeds the roll paper.

12. A printing apparatus according to claim 10, wherein the first paper guide is a flat platen and the print head prints onto the roll paper that is supported by the first guide surface.

13. A printing apparatus according to claim 12, wherein the print head moves along the first guide surface.

14. A printing apparatus according to claim 10, further comprising a paper path that leads the inner surface of the roll paper to the print head, wherein the feed roller contacts the outer surface of the roll paper and feeds the roll paper towards the first guide surface.

15. A printing apparatus according to claim 14, wherein the first paper guide discharges the roll paper along a surface of a main body of the printing apparatus in a direction in which the roll paper is supplied.

16. A printing apparatus according to claim 14, further comprising, between the first paper guide and the feed roller, a cutter that has a movable blade that moves in a direction for cutting the roll paper.

17. A printing apparatus according to claim 16, wherein the movable blade is disposed between the first paper guide and the second paper guide.

18. A printing apparatus according to claim 16, wherein the movable blade is disposed on the feed roller side, and further comprising a fixed blade that is fixed on the print head side and is provided on an opposite side of the first paper guide to the movable blade.

19. A printing apparatus according to claim 18, wherein the first paper guide, the movable blade, and the feed roller are detachable from a main body of the printing apparatus.

20. A printing apparatus according to claim 18, further comprising a roll paper cover that opens and closes with respect to a main body of the printing apparatus when the roll paper is attached, wherein the first paper guide, the movable blade, and the feed roller move together with the roll paper cover with respect to the main body of the printing apparatus.

21. A printing apparatus according to claim 20, wherein the first paper guide discharges the roll paper in a direction of the roll paper cover.

22. A paper feeding apparatus according to claim 1, wherein the roll paper output from the feed roller is discharged with striking the first guide surface after the roll paper contacts with the output end of the second guide surface.

23. A paper feeding apparatus according to claim 1, wherein the first paper guide is a flat platen.

* * * * *